US009424731B2

(12) United States Patent
Korakin et al.

(10) Patent No.: US 9,424,731 B2
(45) Date of Patent: Aug. 23, 2016

(54) MULTI LEVEL HAZARD DETECTION SYSTEM

(71) Applicants: Yosef Korakin, Rockville, MD (US); Guy Slaton-Morgenstern, Rockville, MD (US); Oren Shriki, Rehovot (IL); Nir Geva, Nes Ziona (IL)

(72) Inventors: Yosef Korakin, Rockville, MD (US); Guy Slaton-Morgenstern, Rockville, MD (US); Oren Shriki, Rehovot (IL); Nir Geva, Nes Ziona (IL)

(73) Assignees: Yosef Korakin, Rockville, MD (US); Guy Slaton-Morgenstern, Rockville, MD (US); Oren Shriki, Rehovot (IL); Nir Geva, Nes Ziona (IL)

( * ) Notice: Subject to any disclaimer, the term of this patent is extended or adjusted under 35 U.S.C. 154(b) by 147 days.

(21) Appl. No.: 13/956,412

(22) Filed: Aug. 1, 2013

(65) Prior Publication Data

US 2014/0035750 A1 Feb. 6, 2014

Related U.S. Application Data

(60) Provisional application No. 61/678,152, filed on Aug. 1, 2012.

(51) Int. Cl.

| | |
|---|---|
| ***G08B 17/00*** | (2006.01) |
| ***G08B 21/18*** | (2006.01) |
| ***G08B 23/00*** | (2006.01) |
| *G08B 25/10* | (2006.01) |

(52) U.S. Cl.

CPC ..... *G08B 21/18* (2013.01); *G08B 23/00* (2013.01); *G08B 25/10* (2013.01)

(58) Field of Classification Search

CPC ..... G08B 21/18; G08B 23/00; G08B 25/10

USPC ..... 340/585

See application file for complete search history.

(56) References Cited

U.S. PATENT DOCUMENTS

| | | | | |
|---|---|---|---|---|
| 5,491,467 | A * | 2/1996 | Tracy et al. | 340/522 |
| 6,001,065 | A * | 12/1999 | DeVito | G06F 3/015 340/4.11 |
| 6,023,223 | A * | 2/2000 | Baxter, Jr. | 340/531 |
| 6,081,481 | A * | 6/2000 | Sabatier et al. | 367/8 |
| 6,255,652 | B1 * | 7/2001 | Moyer | 250/343 |
| 6,263,311 | B1 * | 7/2001 | Dildy | 704/273 |
| 6,525,658 | B2 * | 2/2003 | Streetman et al. | 340/522 |
| 6,552,647 | B1 * | 4/2003 | Thiessen et al. | 340/3.1 |
| 6,691,070 | B1 * | 2/2004 | Williams et al. | 702/188 |
| 8,838,260 | B2 * | 9/2014 | Pachet et al. | 700/94 |
| 2002/0096638 | A1 * | 7/2002 | Toomey | 250/341.1 |
| 2003/0039612 | A1 * | 2/2003 | Ovington | 424/9.1 |
| 2004/0162710 | A1 * | 8/2004 | Schwartz | 703/2 |
| 2007/0096928 | A1 * | 5/2007 | Lee | 340/573.2 |

(Continued)

*Primary Examiner* — Quang D Pham

(74) *Attorney, Agent, or Firm* — Reches Patents

(57) ABSTRACT

A multi level hazard detection system for home residents or owners or service providers that want to efficiently monitor and detect numerous common hazards in houses, offices or industrial structures. Hazards that may be dangerous their health or to the structural integrity of their houses, offices and industrial structures and all appliances and systems that are of these structures such as heating and cooling systems, pipes and more. By detecting hazards in advance, residents home owners and service providers can better protect their property. The multi level hazard detection system generally includes Single or Multi Sensor Device (170) that can be based on Low Power Communication Module (110), A Monitor and Control Device (140) which can be a mobile phone, desktop or laptop computer, an Analytic Server (150) and Relay Dongle (160).

16 Claims, 15 Drawing Sheets

(56) References Cited

U.S. PATENT DOCUMENTS

2007/0192032 A1* 8/2007 David ..... A01M 31/002 702/19
2008/0069364 A1* 3/2008 Itou ..... H04R 5/04 381/17
2009/0093917 A1* 4/2009 Smith ..... 700/300
2010/0201529 A1* 8/2010 Garrick ..... 340/628
2011/0190008 A1* 8/2011 Eronen ..... G01C 21/20 455/456.3
2013/0041856 A1* 2/2013 Benitez et al. ..... 706/12
2013/0322215 A1* 12/2013 Du et al. ..... 367/136

* cited by examiner

200

510

MULTI LEVEL HAZARD DETECTION SYSTEM

RELATED APPLICATIONS

This application claims the benefit from U.S. provisional patent Ser. No. 61/678,152 filing date Aug. 1, 2012 which is incorporated herein by reference.

BACKGROUND OF THE INVENTION

The present invention relates generally to environmental monitoring and more specifically it relates to multi level hazard detection system for home residents, owners or service providers that want to efficiently monitor and detect numerous common hazards in houses, offices or industrial structures. Hazards that may be dangerous their health or to the structural integrity of their houses, offices and industrial structures and all appliances and systems that are of these structures such as heating and cooling systems, pipes and more. By detecting hazards in advance, residents, home owners and service providers can better protect their property.

BRIEF SUMMARY OF THE INVENTION

The invention generally relates to an environmental monitoring which includes Single or Multi Sensor Device (170) that can be based on Low Power Communication Module (110), A Monitor and Control Device (140) which can be a mobile phone, desktop or laptop computer, an Analytic Server (150) and Relay Dongle (160).

There has thus been outlined, rather broadly, some of the features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a multi level hazard detection system for home residents, owners or service providers that want to efficiently monitor and detect numerous common hazards in houses, offices or industrial structures. Hazards that may be dangerous to their health or to the structural integrity of their houses, offices and buildings and all appliances and systems that are inside these buildings such as heating and cooling systems, pipes and more. By detecting hazards in advance, residents, home owners and service providers can better protect their property.

Another object is to provide a Multi Level Hazard Detection System that accurately detects termites inside walls.

Another object is to provide a Multi Level Hazard Detection System that accurately detects rodents.

Another object is to provide a Multi Level Hazard Detection System that accurately detects moles inside and around walls and close cabinets.

Another object is to provide a Multi Level Hazard Detection System that detects radon (Rn) gas in basements.

Another object is to provide a Multi Level Hazard Detection System that provides a simple monitoring application that is accessible for the user at any given moment.

Another object is to provide a Multi Level Hazard Detection System that is modular and have the ability to be upgraded with more sensors to detect new kind of hazards.

Another object is to provide a Multi Level Hazard Detection System that collects data from houses, offices or industrial buildings to provide tools for policy makers to take collective action in solving common hazards.

Another object is to provide a Multi Level Hazard Detection System that can detect changes in refrigerator's temperature and to alert the user about these changes.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

SUMMARY

There may be provided a system comprising an analytics server that is arranged to process detection signals to search for an existence of at least one hazard; wherein the detection signals reflect a sensing of an environment by at least one hazard detection sensor, and to generate information relating to the existence of the hazard. An environment of a hazard detection sensor may include any location that a parameter of that location can be sensed by hazard detection sensor, alternatively is may be regarded as the detection zone of the hazard detection sensor.

The may include the at least one hazard detection sensor; wherein the at least one hazard detection sensor is prevented from processing the detection signals to search for an existence of at least one hazard.

The system may include the at least one hazard detection sensor; wherein the at least one hazard detection sensor is arranged to transmit the detection signals only after determining that the detection signals represent a change in the environment.

The detection signals may represent at least one out of audio, vibration, moist and temperature sensed by the at least one hazard detection sensor.

The at least one hazard may include at least one out of (a) an existence of termites inside a wall of a building, (b) an existence of moles inside or around walls or close cabinets, (c) an existence of Radon gas in a basement, or (d) an existence of rodents at the environment of the hazard detection sensor.

The detection signals may be indicative of a temperature within a refrigerator and wherein the analytic server is arranged to determine that the refrigerator does not operate properly in response to the temperature within the refrigerator.

The analytics server may be arranged to process detection signals from at least two different types of hazard detection sensor before declaring that a hazard exists.

The analytics server may be arranged to apply hazard detection algorithms of different types for detecting different hazards.

The analytics server may be arranged to calculate an attribute of a certain frequency components of a group of detection signals obtained during a time window, wherein the certain frequency range is characteristic of a certain hazardous animal and determine whether the certain hazardous animal is located at a vicinity of a one hazard detection sensor.

The analytics server may be arranged to: calculate, a for each point of time out of multiple points in time of a time window, a sum of amplitudes of spectral components of the detection signals within a frequency window thereby providing multiple sums associated with the multiple points in time; and process the multiple sums to search for a signature that is characteristic of a hazardous animal.

According to an embodiment of the invention there may be provided a method that may include processing, by an analytics server, detection signals to search for an existence of at least one hazard; wherein the detection signals reflect a sensing of an environment by at least one hazard detection sensor, and generating information relating to the existence of the hazard.

The method may include generating the detection signals by the at least one hazard detection sensor; wherein the at least one hazard detection sensor is prevented from processing the detection signals to search for an existence of at least one hazard.

The method may include transmitting, by the at least one hazard detection sensor, the detection signals only after determining that the detection signals represent a change in the environment.

The detection signals represent at least one out of audio, vibration, moist and temperature sensed by the at least one hazard detection sensor.

The at least one hazard comprises at least one out of (a) an existence of termites inside a wall of a building, (b) an existence of moles inside or around walls or close cabinets, (c) an existence of Radon gas in a basement, or (d) an existence of rodents at the environment of the hazard detection sensor.

The detection signals are indicative of a temperature within a refrigerator and wherein the method comprises determining by the analytics server that the refrigerator does not operate properly in response to the temperature within the refrigerator.

The method may include processing detection signals from at least two different types of hazard detection sensor before declaring that a hazard exists.

The method may include applying hazard detection algorithms of different types for detecting different hazards.

The method may include calculating an attribute of a certain frequency components of a group of detection signals obtained during a time window, wherein the certain frequency range is characteristic of a certain hazardous animal and determining whether the certain hazardous animal is located at a vicinity of a one hazard detection sensor.

The method may include calculating, a for each point of time out of multiple points in time of a time window, a sum of amplitudes of spectral components of the detection signals within a frequency window thereby providing multiple sums associated with the multiple points in time; and processing the multiple sums to search for a signature that is characteristic of a hazardous animal.

There may be provided a single or multi sensor device that comprises an acoustic sensor, and an elastic funnel, wherein when the single or multi sensor device is installed on a wall the elastic funnel isolates the acoustic sensor from acoustic signals originating outside the wall and allows acoustic signals generated in the wall to propagate towards the acoustic sensor.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE DRAWINGS

Figure 1:
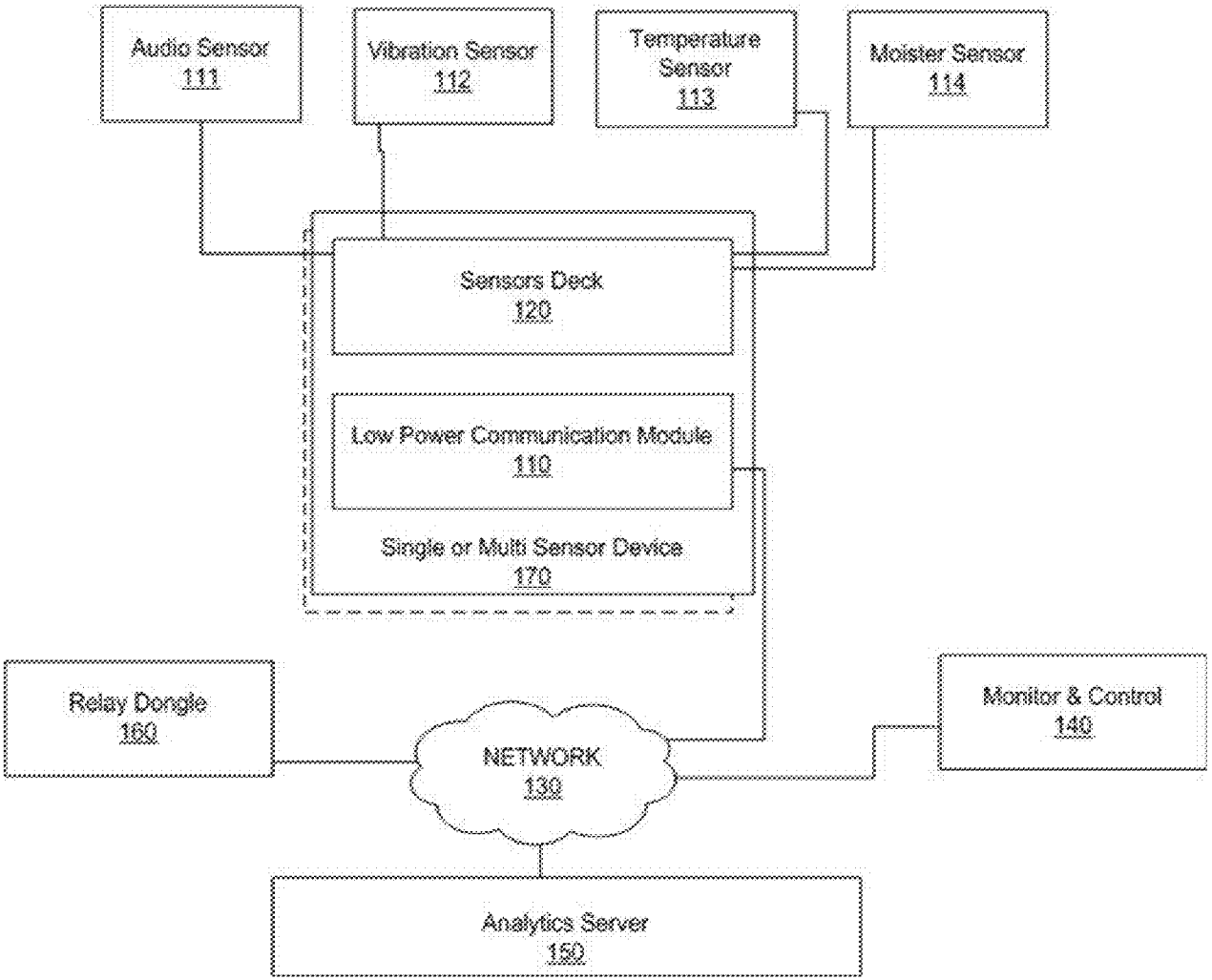
FIG. 1 is a block diagram illustrating a system according to an embodiment of the invention.

Various other objects, features and attendant advantages of the present invention will become fully appreciated as the same becomes better understood when considered in conjunction with the accompanying drawings, in which like reference characters designate the same or similar parts throughout the several views, and wherein:

DETAILED DESCRIPTION OF THE INVENTION

FIG. 1 is a block diagram illustrating the overall of the present invention. It includes the key components of the system such as, multi sensors (blocks 111-114), The Low Power Communication Module (110) which aggregates the sensors inputs and forward these inputs to Monitor & Control (140) or to the Relay Dongle (160). The monitor and control can analyze the inputs to provide audio visual feedback or text notifications to the user or it can forward some of the processed inputs to Analytic Server (150). The Relay Dongle (160) just forwards the data to the Analytic Server (150). The Analytic Server (150) is a server side service that process complicated detection algorithms, and delivers immediate feedback to the Monitor & Control (140), and creates robust reports for individuals and organizations to help them in addressing the detected hazards in an efficient manner. The sensor may include an ultrasonic sensor, a video sensor, a radar sensor and the like.

Figure 2:
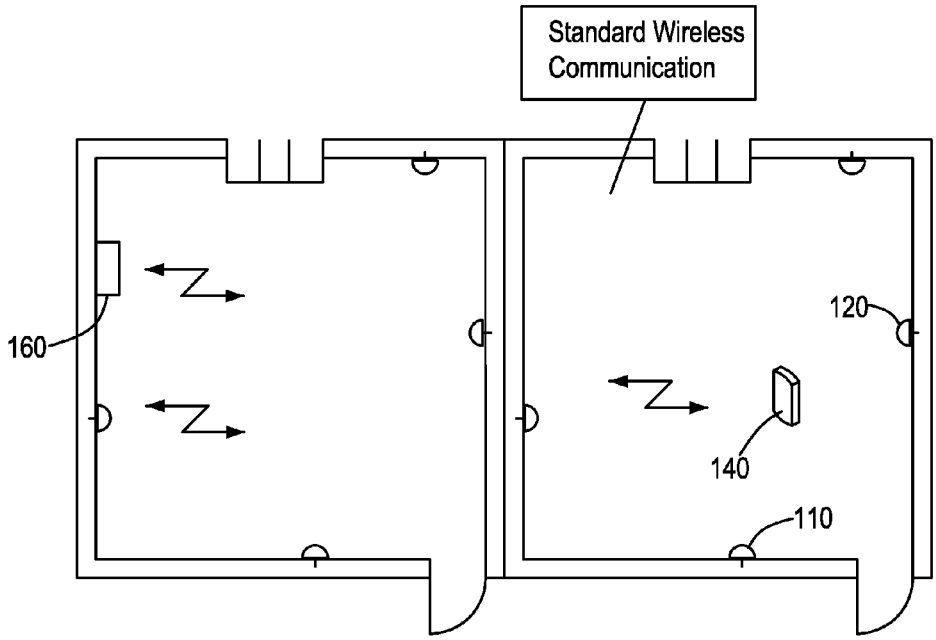
FIG. 2 is a top view of various components of the system of FIG. 1 that are installed in a house according to an embodiment of the invention.

FIG. 2 is a top view of the present invention. Illustrating an installation of the system in two rooms in a house, with a multi sensors (combination of 111-114 blocks and 110 and 120 blocks) located on each wall. Each unit sends its sampled sensors data to the Monitor & Control (140) or to the Relay Dongle (160).

Figure 3:
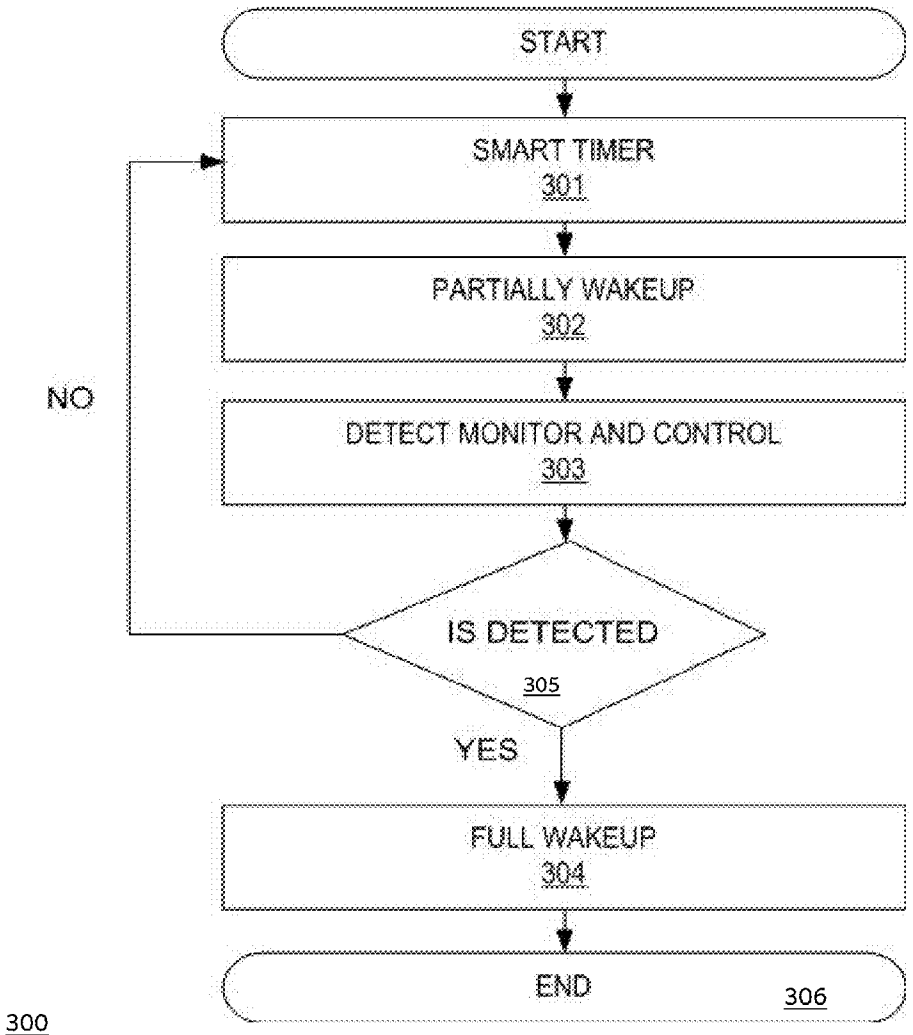
FIG. 3 illustrates a method according to an embodiment of the invention.

FIG. 3 is a flowchart illustrating a sub-operation 300 of the present invention. The following figure includes the process of the Low Power Communication Module (110). The process defines the flow of data from the sensor to the Monitor and Control device (140) and/or to the Relay Dongle (160) which forwards the data to the Analytic Server (150). It includes stages 301-306.

Figure 4:
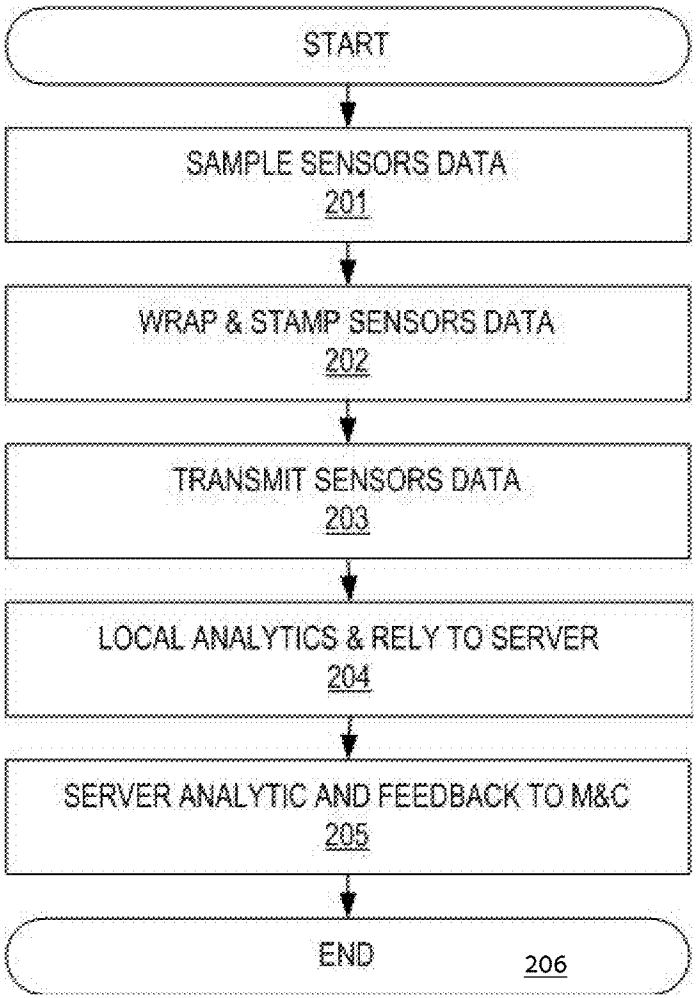
FIG. 4 illustrates a method according to an embodiment of the invention.

FIG. 4 is a flowchart illustrating the overall operation 400 of the present invention. The following figure describes how the Low Power Communication Module (110) regulates its power conception by turning off power consuming functions whenever they are not required for the proper operation of the module. It include stages 401-406.

Figure 5:
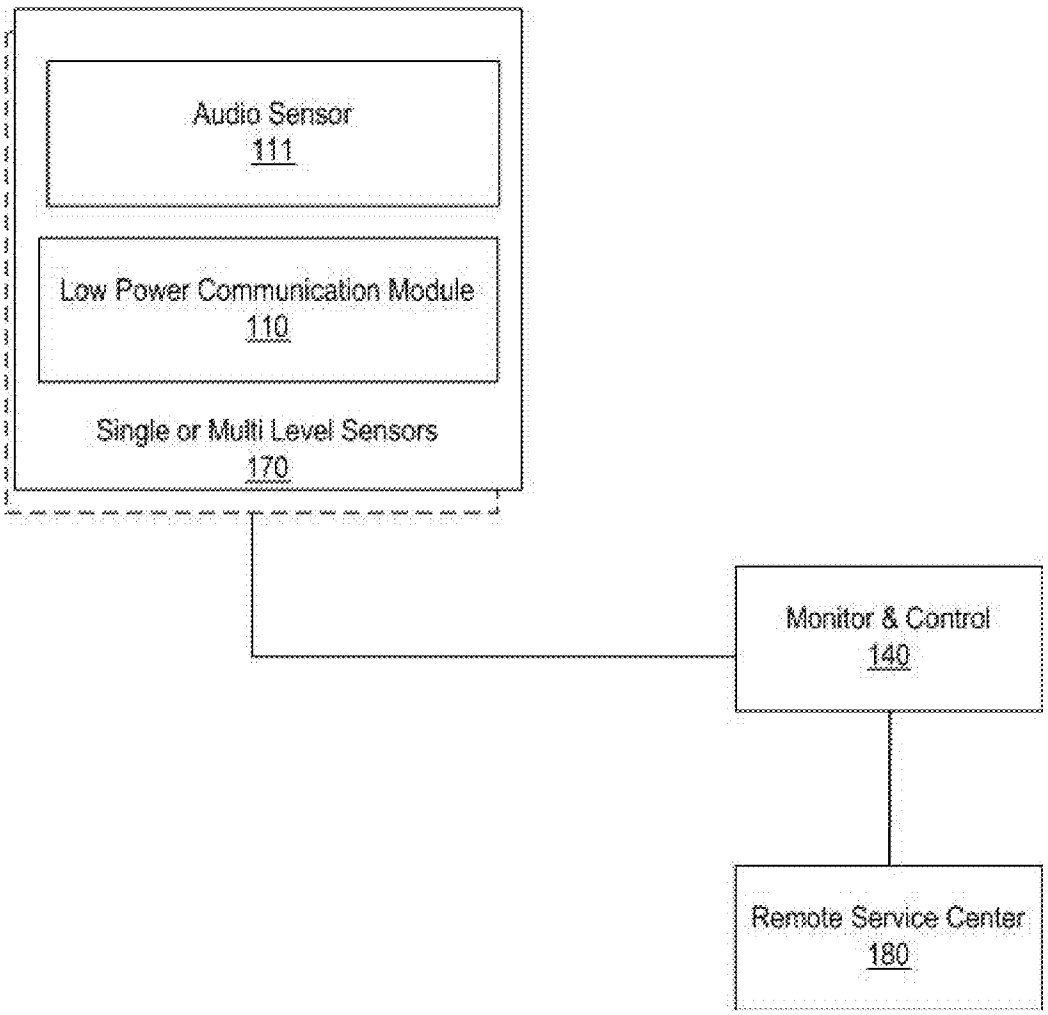
FIG. 5 illustrates various components of a system according to an embodiment of the invention.

FIG. 5 is an alternative embodiment of the present invention. The following figure describes an alternative overall view of the proposed invention.

Figure 6:
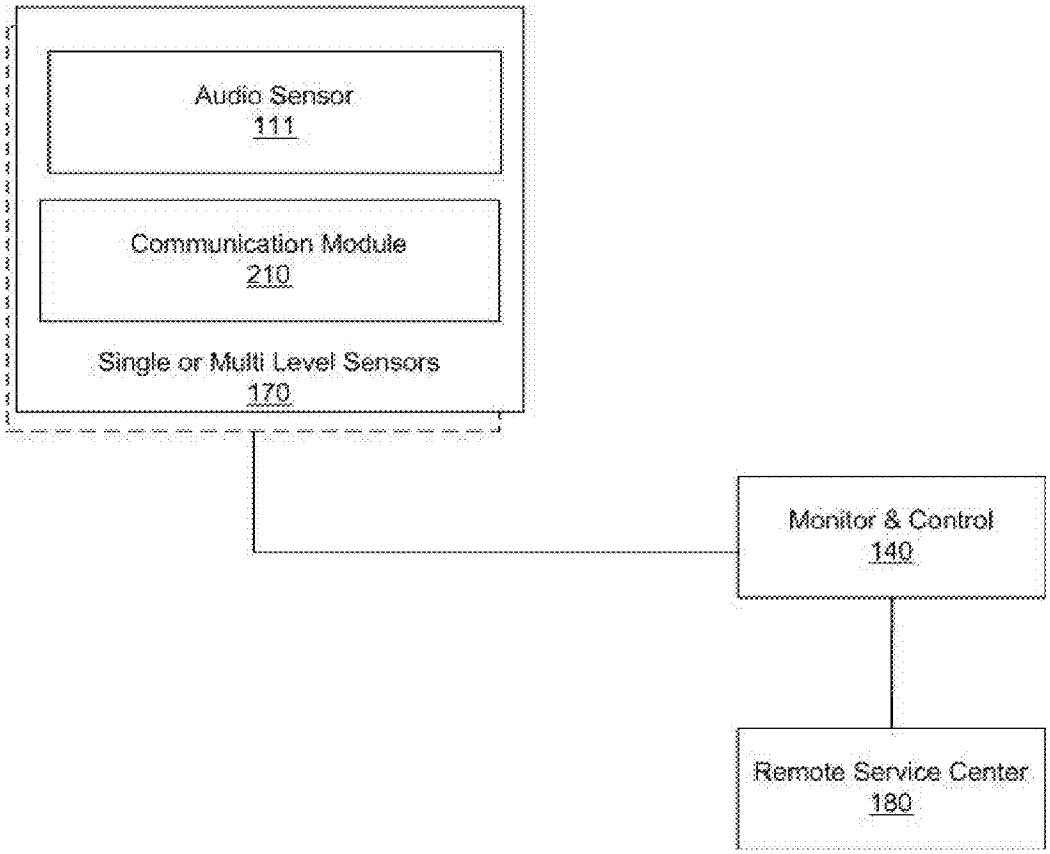
FIG. 6 illustrates various components of a system according to an embodiment of the invention.

FIG. 6 is a second alternative embodiment of the present invention. The following figure describes an alternative overall view of the proposed invention, that doesn't requires Low Power Communication Module (110) just Communication Module (210).

Figure 7:
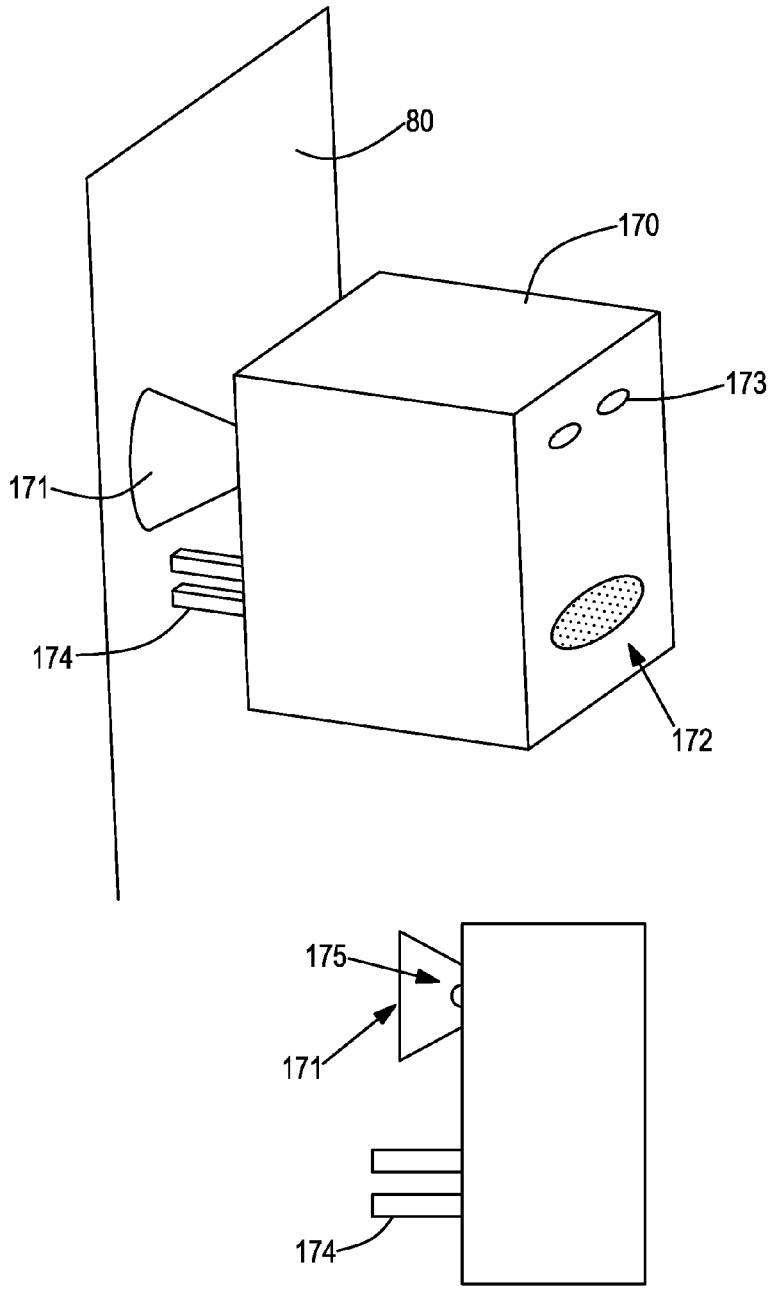
FIG. 7 illustrates a Single Or Multi Sensor Device according to an embodiment of the invention.

FIG. 7 illustrates a Single Or Multi Sensor Device 170 according to an embodiment of the invention. It has two light emitting diodes (LEDS) 173 and a microphone 172 at its front panel, an electrical plug 174 and elastic funnel 171 that assists in conducting sound waves from a wall 80 on which the Single Or Multi Sensor Device 170 installed to a microphone 175. The elastic funnel 171 can be made from elastic material and can have a conical shape or any other shape. Once the Single Or Multi Sensor Device 170 is installed on a wall (or another object) the elastic funnel 171 and that wall can defined a relatively close and substantially isolated space in which sound acoustic waves from the wall can propagate substantially without interference to the microphone. The elastic funnel, when the single or multi sensor device is installed on a wall, isolates the acoustic sensor from acoustic signals originating outside the wall and allows acoustic signals generated in the wall to propagate towards the acoustic sensor.

Figure 8:
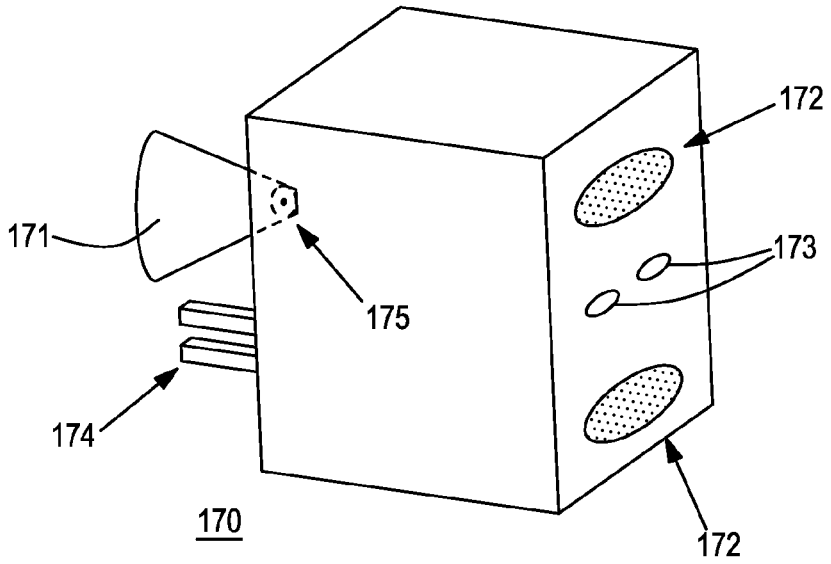
FIG. 8 illustrates a Single Or Multi Sensor Device according to an embodiment of the invention.

FIG. 8 illustrates a Single Or Multi Sensor Device 170 according to an embodiment of the invention. It has two light emitting diodes (LEDS) 173 and two microphones 172 at its front panel, an electrical plug 174 and elastic funnel 171 that assists in conducting sound waves from a wall 80 on which the Single Or Multi Sensor Device 170 installed to a microphone 175.

Figure 9:
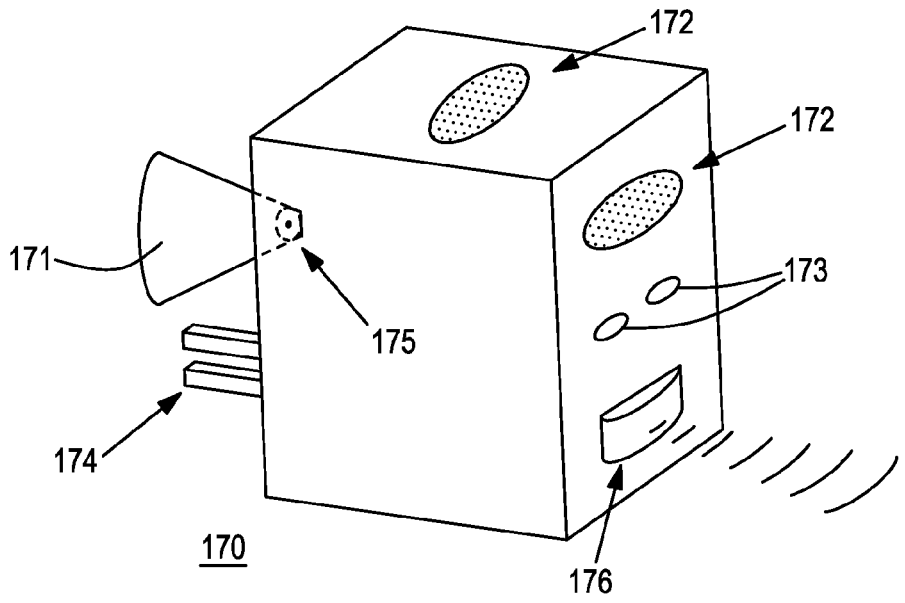
FIG. 9 illustrates a Single Or Multi Sensor Device according to an embodiment of the invention.

FIG. 9 illustrates a Single Or Multi Sensor Device 170 according to an embodiment of the invention. It has two light emitting diodes (LEDS) 173 and a microphone 172 at its front panel, another microphone 172 at its top panel, an electrical plug 174 and elastic funnel 171 that assists in conducting sound waves from a wall 80 on which the Single Or Multi Sensor Device 170 installed to a microphone 175. It also has an ultrasonic sensor 176 that is illustrated as emitting ultrasonic waves.

Figure 10:
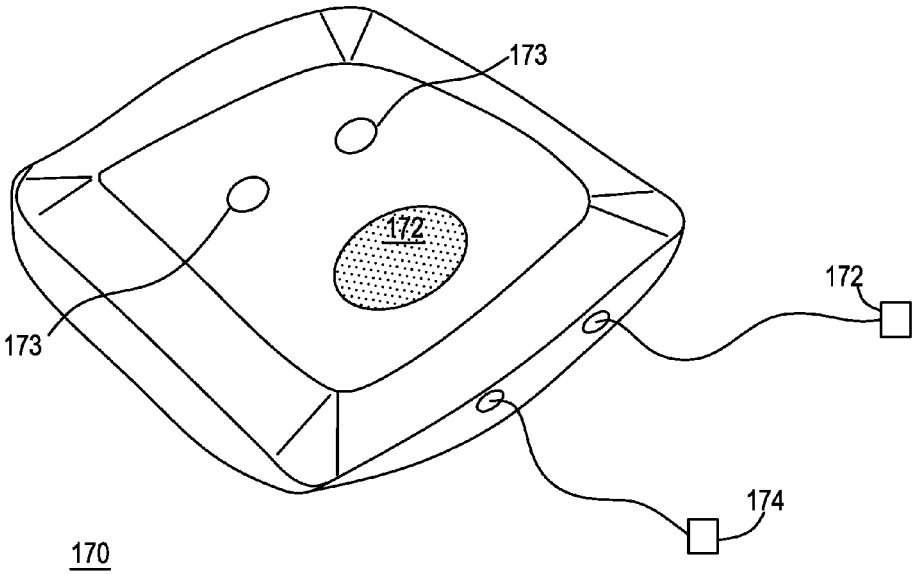
FIG. 10 illustrates a Single Or Multi Sensor Device according to an embodiment of the invention.

FIG. 10 illustrates a Single Or Multi Sensor Device 170 according to an embodiment of the invention. It has a two light emitting diodes (LEDS) 173 and a microphone 172 at its front panel, can have conductor that allows it to be coupled to an electrical plug 174 and another wire that couples it to an external microphone 172.

Figure 11:
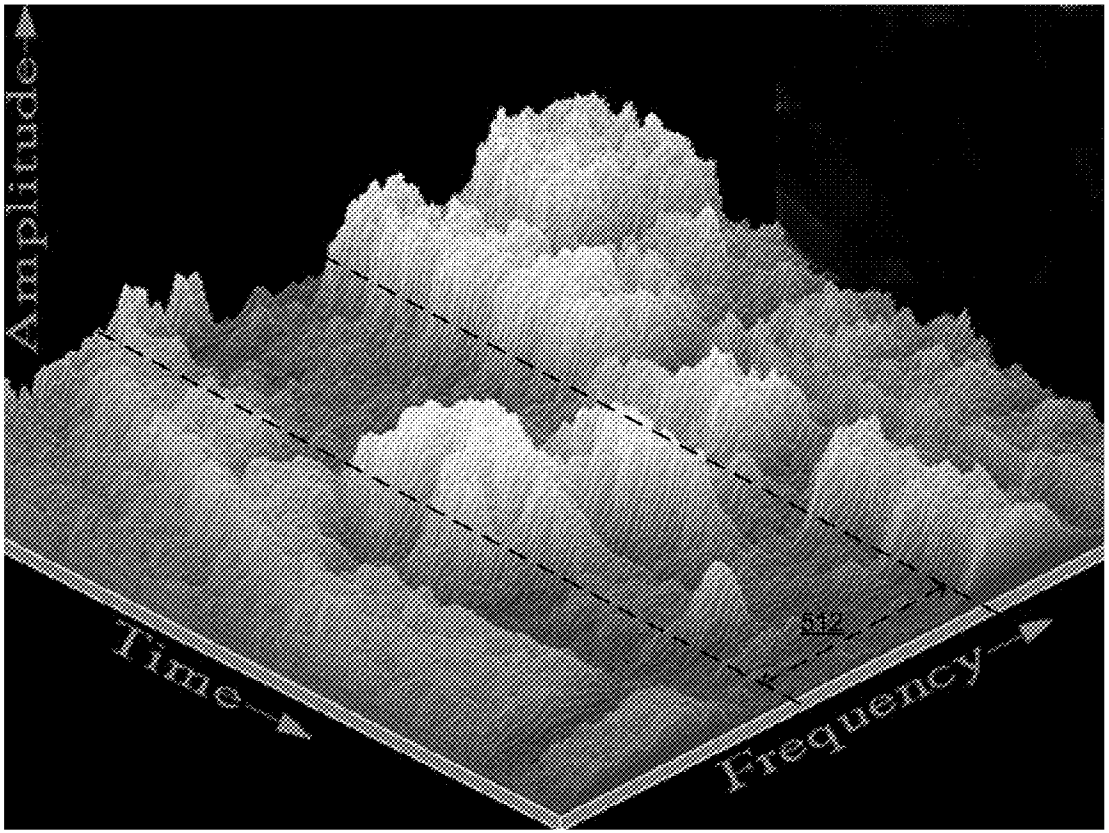
FIG. 11 illustrates a graph that illustrates multiple spectral components of multiple detection signals according to an embodiment of the invention.

FIG. 11 illustrates a graph 510 that illustrates multiple spectral components of multiple detection signals according to an embodiment of the invention. It also illustrates a frequency window 512.

Figure 12:
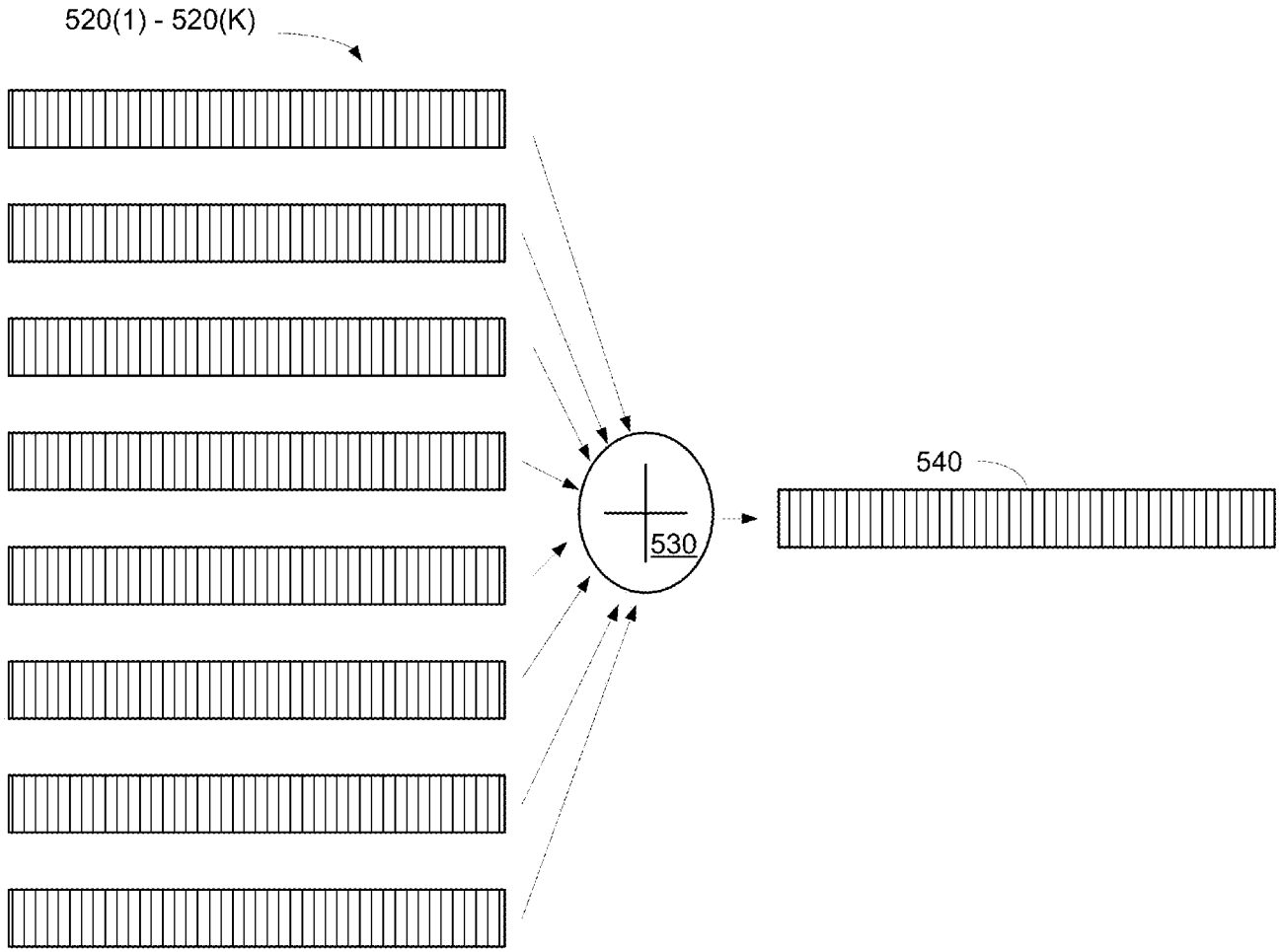
FIG. 12 illustrates multiple vectors that are obtained from the multiple spectral components of multiple detection signals according to an embodiment of the invention.

FIG. 12 illustrates multiple (K) vectors 520(1)-520(K) that are obtained from the multiple spectral components of multiple detection signals according to an embodiment of the invention. These K spectral components can belong to a frequency window such as 512. These multiple (K) vectors 520(1)-520(K) are summed (530) to provide sum vector 540.

Figure 13:
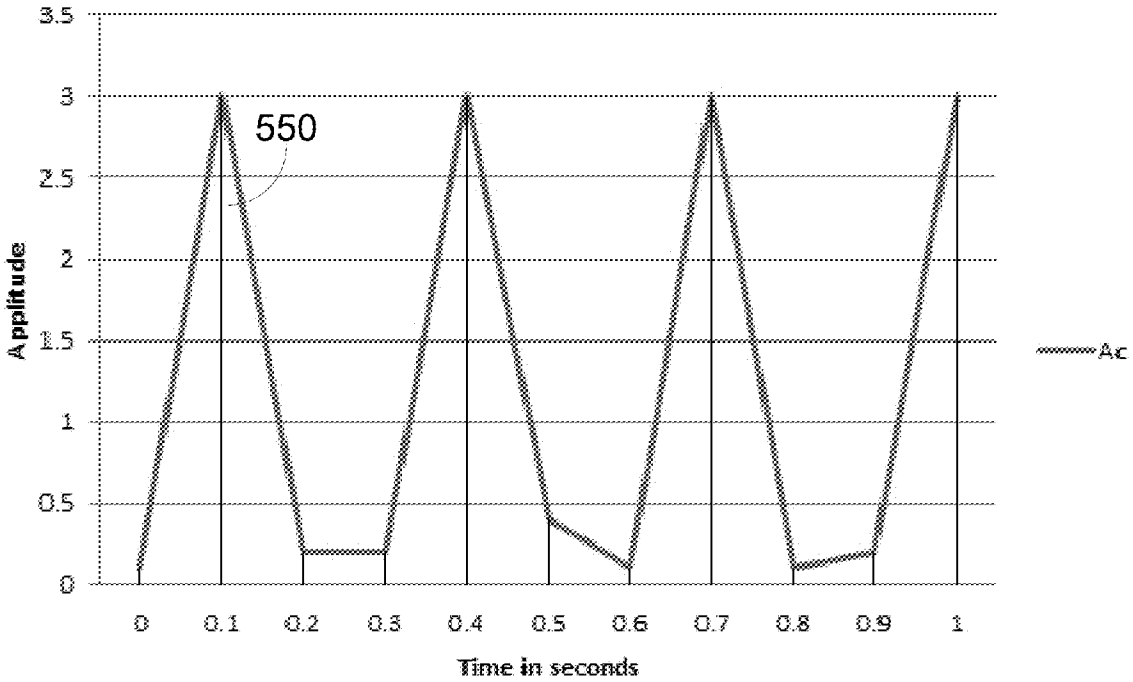
FIG. 13 illustrates multiple elements of a sum vector according to an embodiment of the invention.

FIG. 13 includes a graph 550 that illustrates the values of multiple elements of sum vector 540 according to an embodiment of the invention.

OVERVIEW

Turning now descriptively to the drawings, in which similar reference characters denote similar elements throughout the several views, the figures illustrate Single or Multi Sensor Device (170) that can be based on Low Power Communication Module (110), A Monitor and Control Device (140) which can be a mobile phone, desktop or laptop computer, an Analytic Server (150) and Relay Dongle (160).

A. Single Or Multi Sensor Device (170)

This element can be but not limited to the size of a small tennis ball. It has a set of sensors that sense different features such as sound, vibration moist and more and it includes a processor and communication unit that are wrapped in but not just in plastic or metal package, and can be mounted to a room's wall. The main function of this element is to transmit sensors information back to the Monitor & Control (140) device or to the Relay Dongle (160).

The Single or Multi Sensor Device (170) includes three different parts. The first part is a set of sensors of different types that constantly sense changes in the nearby environment. The sensors which can sense sound, vibration, moist and other features are connected to what is called Sensor Deck (120), which aggregates all the data from the different sensors and wrap this data into data packages that are time stamped and forward to future processing. The last part is the Low Power Communication Module (110) that wakes up at certain times slot (as described in FIG. 3) to deliver the data packages to the Relay Dongle (160) or the Monitor and Control Device (140).

The Single or Multi Sensor Device (170) can endorse numerous sensors with different configuration for different types of hazard detection. It can be based on a system on a chip architecture that wraps all functionality from sensor to communication into one chip, or it can have modular architecture to allow the easy addition or removal of sensors from the device. The device can be physically plugged into a wall or lay in a cabinet depending of the system application requirements. The device can be wrapped in plastic or metal package or any other suitable material and suitable design that fit the device functionality, marketing and sales requirements. Various examples of this component are shown in FIGS. 6-10.

B. Monitor & Control Device (140)

This device can be mobile phone or desktop computer. It delivers an audiovisual status of different sensors and provides the user with the ability to understand whether there is a problem or not that requires immediate intervention. For example, it can detect termite's activity in one of the walls. The Monitor & Control Device (140) can also act as relay that sends all the information directly to the analytic server.

The Monitor & Control Device (140) is a user device with audiovisual interface, to provide with the user with the most up to date information about potential hazards in his house. In addition, the device can access the user account located at the server side, and provide the user the ability to define his account, to add new sensors, to request and pay for new services, to generate reports and to get any service that is derived out of his but not just his sensors data.

The Monitor and Control Device (140) can be smartphone, touchpad, laptop computer, desktop computer and any device that can run audio visual applications and is but not necessarily connected to the web.

C. Analytic Server (150)

This element is a standard web server. It provides the following but not just the following functionality:

- Processing sensors data to analyze whether there is a hazardous event near the relevant sensor or set of sensors.
- Manages service DB to serve and collect the right data from and to the right user.
- Provides an advance in depth analysis that enable policy makers, corporate or and collective entity to understand its common status. An example for trend report could be the burst of termites in a neighborhood.

Analytic Server (150) is a machine that runs a set of web services that provides the following functionality—user management, sensors management, hazard status, trends and reports, notification services, deep analysis of collected data to provide up to date hazard detection information.

The Analytic Server (150) can be comprised out of one machine or a set of tightly connected machines that handle data and processing management to many users simultaneously.

D. Relay Dongle (160)

This element is a small device that is plugged but not necessarily plugged to a house electrical outlet. It communicates with the different sensors, collects their streamed data and forwards the data to the Analytic Server (150).

It provides a connection between the Single or Multi Sensor Devices (170) and the Analytic Server (150). It includes all the session management business logic that handles the data transmission. It manages a discovery mechanism that enables an easy installation of a new Single or Multi Sensor Device (170). It communicates with the Single or Multi Sensor Devices (170) through wired or wireless communication. It can be configured and controlled wirelessly or through cable port.

The Relay Dongle can be smartphone, touchpad, laptop or desktop computer. It can also be implemented as dedicated appliance with its specific shape and size. It can be plug to an AC outlet or it can run on battery.

E. Connections of Main Elements and Sub-Elements of Invention

The different sensors (111-114) are connected through a physical medium such as cable or line to the Sensors Deck (120). The Sensors Deck (120) is connected to the Low Power Communication Module (110) with cable or line. Both parts, 110 and 120, are part of the Single or Multi Sensor Device which communicates with the Relay Dongle (160) or the Monitor & Control (140) through wired or wireless communication. The Relay Dongle (160) or the Monitor & Control (140) are connected to the Analytic Server (150) via TCP/IP network communication.

F. Alternative Embodiments of Invention

An alternative solution can include single sensor detection system that is wired directly to Monitor & Control Device (140). In this case the Monitor & Control Device (140) is an appliance that is not portable and is mounted to a wall. It provides alarms to the user, and it communicates with a service center (180) when needed much like an alarm system.

Another alternative solution can include a Communication Module (210) and not Low Power Communication Module (110). The difference is that in the Communication Module (210) there is no need to regulate the power consumption of the Single or Multi Sensor Device (170).

G. Operation of Preferred Embodiment

The Single or Multi Sensor Device (170) is installed in houses on walls or inside cabinets or any other close compartments. It records data from its near surrounding environment. The data can include but not just include, audio, vibration, moist, temperature and more. The data is being relay and analyzed in a remote server to detect hazardous events such as termites biting wall's wood, radon gas accumulation in basement, potential moles, refrigerator malfunction and more. This on-going analysis of received data is done by an Analytic Server (150) that has the processing power and the ability to manage and link hazardous events to registered users. Registered users can monitor their house status by using the Monitor & Control device (140) which can be any handheld device or computer with an operating system that can run monitor & control application. This device (140) is constantly connected to the Analytic Server (150) to receive notifications about hazards status that may be of an interest to the user. For example, a user may have a sensor in the refrigerator that can sense the temperature. The temperature data is sent to the Analytic Server (150) via the Relay Dongle (160). The Analytic Server (150) may detect that the temperature is beyond the required temperature by a standard refrigerator which means that something is wrong with the refrigerator operation. Then a notification can be sent to the user which will help the user take action and solve the problem. Another example is the sound sensors that records audio from specific wall and sends the samples via Relay Dongle (160) to the Analytic Server (150). The Analytic Server (150) can filter the audio to detect specific sound that is created by termites biting through the wall's wood. If there is a positive detection a notification is made to the user which will take the proper actions, terminating the threat. In some cases, the Analytic Server (150) will run a detection algorithm that requires few types of sensors in order to reach a better and more accurate detection. For example, termites can be detected by sound and high CO2 in their close environment. An audio sensor and a CO2 sensor that are located close enough can together provide a better and more reliable detection of termites.

G Detection of Chirps that Represent Various Hazardous Animals

The following algorithm was created to detect different types of chirp sounds which can be applied mainly to rodents but also to termites.

The algorithm includes the following steps:

Receiving sound samples using microphone or file as a source. The source is being segmented using a configurable time window, for example 1 second. Using a spectrogram operation we convert the signal into three dimensional function S which represent the signal power at a certain time frequency point (see, for example graph 550 of FIG. 11).

Different animals chirps like Rodent and Termites have dominating frequencies that represents their chirp. Based on the animal the system is configured to filter the relevant frequencies using a band pass filter. Since the spectrogram already includes a frequency representation of the signal the filtered spectrogram is no more than zeroing the amplitude values in every component that is out of the animal's chirp frequency window.

$$Sf = S \times U$$

$$U(f) = \begin{cases} 1, fs < f < fe \\ 0, \text{Otherwise} \end{cases}$$

Sf is a three dimensional discrete function. This function can be represented as a list of vectors Ai, where each vector $a_{fi}(n)$ in the list Ai represent the amplitude in different times in a single frequency. Vectors 520(1)-520(K) illustrates multiple (K) of such vectors.

We then sum the vectors to create $Ac=\Sigma_{i=0}^{K}a_{fi}$, (see for example vector 540 of FIG. 12 and graph 550 of FIG. 13) creating a new vector that represents the sum of amplitudes of all the frequencies in the relevant frequency window U in every vector time element. The vector Ac (for example graph 550 of FIG. 13) is therefore a discrete function of amplitude in different times. The following graph represents how Ac can look for Rodents.

The next stage in the detection algorithm is to detect the dominating frequency in Ac function. Rodent or termites chirp can be characterized by that frequency. We first use FFT to create Afc=fft(Ac)

We then determine whether there is a significant signal in the representing frequency (usually each animal has a different representing). We use a simple band pass filter around the representing frequency and we measure the signal power to determine whether it is above a certain threshold. In addition we measure the signal to noise ratio and compare to threshold. If the two results are above threshold we mark the 1 second window as detected.

In order to reduce our false positive we notify a positive detection only after X (>5) detections in a time period of Y (<30 minutes).

Another approach to detect the signal is to send Ai, the three dimensional filtered array to a neural network.

Figure 14:
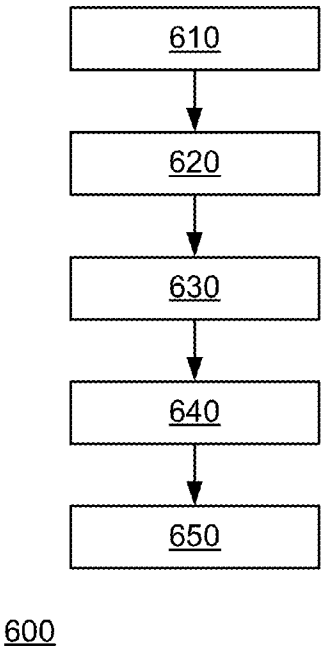
FIG. 14 illustrates a method according to an embodiment of the invention.
Figure 15:
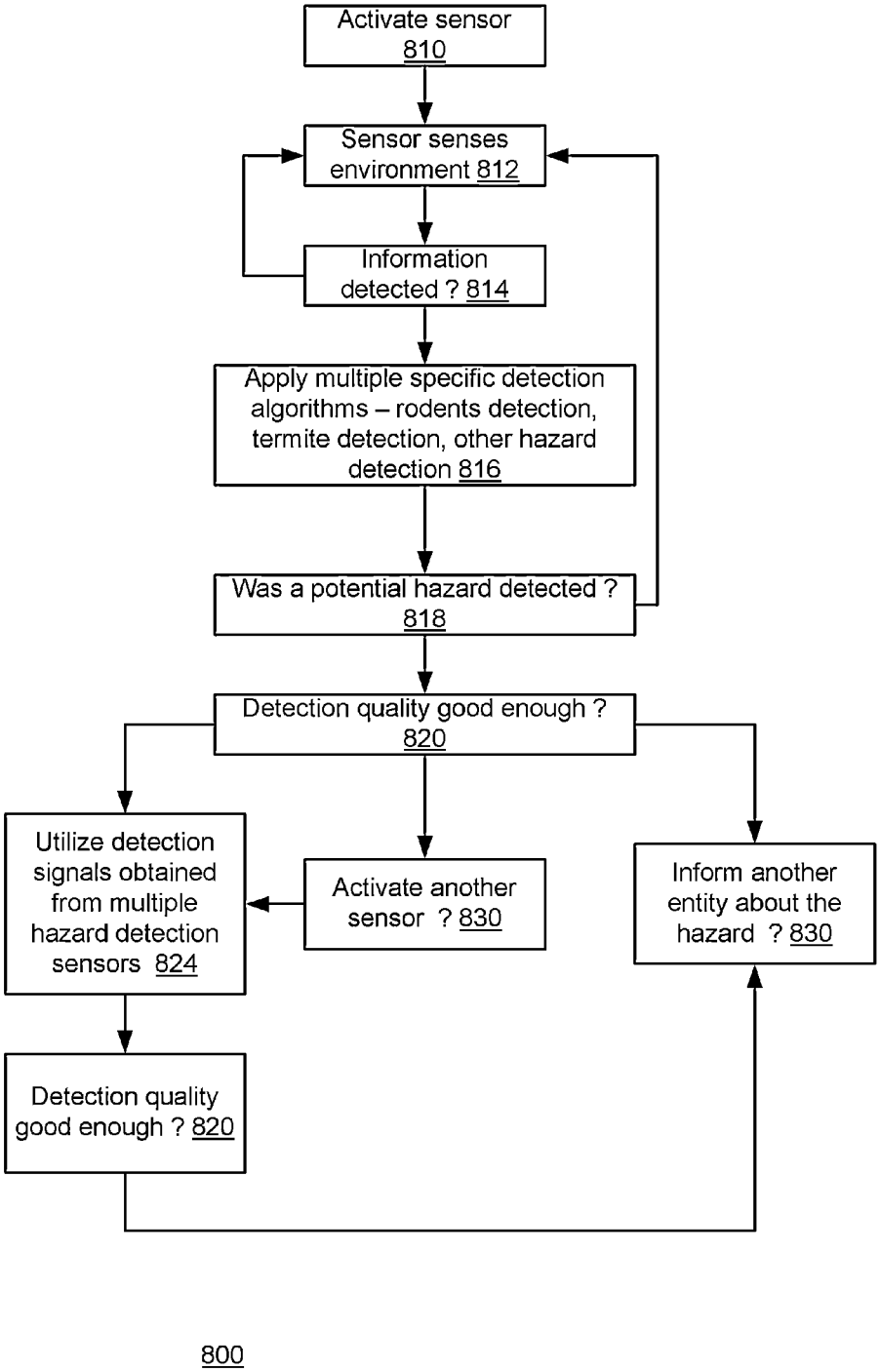
FIG. 15 illustrates a method according to an embodiment of the invention.

FIG. 14 illustrates method 600 according to an embodiment of the invention.

The following explanation will refer to a single hazard detection sensor although it is applicable to multiple hazard detection sensors.

Method 600 may start by stage 610 of sensing of an environment of a hazard detection sensor by the hazard detection sensor and generating detection signals to represent the sensing. The hazard detection sensor can be prevented from processing the detection signals to search for an existence of at least one hazard. This allows such a hazard detection sensor to be cheap and allow the analytics server to perform the processing. The detection signals may represent at least one out of audio, vibration, moist and temperature.

Stage 610 may be followed by stage 620 of transmitting by the hazard detection sensor the detection signals. Alternatively the transmitting can occur only if the hazard sensor determines that there is a need to transmit these detection signals. For example—the transmitting may occur only after determining that the detection signals represent a change in the environment—or otherwise represent information and not just noise.

Stage 620 may be followed by stage 630 of providing the detection signals to an analytics server. This may involve relaying the detection signals by a relay dongle, transmitting the detection signals by a monitor and control device, transmitting the detection signals by a one or multiple sensors device and the like. The transmitting of stages 620 and/or 630 may involve communication processing—segmenting, packetizing, framing, aggregating, error correction and the like.

Stage 630 may be followed by stage 640 of processing, by the analytics server, the detection signals to search for an existence of at least one hazard.

Stage 640 may include at least one of the following:

(a) Processing detection signals from at least two different types of hazard detection sensor before declaring that a hazard exists.

(b) Applying hazard detection algorithms of different types for detecting different hazards.

(c) Calculating an attribute of a certain frequency components of a group of detection signals obtained during a time window, wherein the certain frequency range is characteristic of a certain hazardous animal and determining whether the certain hazardous animal is located at a vicinity of a one hazard detection sensor.

(d) Calculating (see FIGS. 12 and 13), for each point of time out of multiple points in time of a time window, a sum of amplitudes of spectral components of the detection signals within a frequency window thereby providing multiple sums associated with the multiple points in time; and processing the multiple sums to search for a signature that is characteristic of a hazardous animal.

The hazard may include at least one out of (a) an existence of termites inside a wall of a building, (b) an existence of moles inside or around walls or close cabinets, or (c) an existence of Radon gas in a basement.

The detection signals may be indicative of a temperature within a refrigerator and stage 640 may include determining by the analytics server that the refrigerator does not operate properly in response to the temperature within the refrigerator.

Stage 640 may be followed by stage 650 of generating information relating to the existence of the hazard.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicatefunneld. Any headings utilized within the description are for convenience only and have no legal or limiting effect.

What is claimed is:

1. A system comprising:

an analytics server that is arranged to:

process detection signals generated from an acoustic sensor that is configured to sense chirp sound signals generated by a hazardous animal to search for an existence of the hazardous animal; and generate information relating to the existence of the hazardous animal;

wherein the analytics server is configured to process the detection signals by calculating an attribute of a certain frequency component of a group of detection signals obtained by the acoustic sensor during a time window;

wherein a certain frequency range of the detection signals is characteristic of the chirp sound signals generated by the hazardous animal; and wherein the analytics server is arranged to calculate for each point of time out of multiple points in time of the time window, a sum of amplitudes of spectral components of the detection signals within the certain frequency range thereby providing multiple sums associated with the multiple points in time; and process the multiple sums to search for a signature comprising a pattern of sums that is the characteristic of the chirp sound signals generated by the hazardous animal to indicate the existence of the hazardous animal.

2. The system according to claim 1 wherein the analytics server is configured to process the multiple sums by applying a fast Fourier transform on the multiple sums and to search in a frequency domain for the signature that is the characteristic of the chirp sound generated by the hazardous animal.

3. The system according to claim 1, wherein the analytics server is arranged to process additional detection signals generated from a carbon dioxide sensor that is configured to sense carbon dioxide omitted by the hazardous animal.

4. The system according to claim 3 wherein the analytics server is arranged to process the detection signals from the acoustic sensor and the carbon dioxide sensor before declaring the existence of the hazardous animal.

5. The system according to claim 1 further comprising the acoustic sensor; wherein the acoustic sensor is prevented from processing the detection signals to search for the existence of the hazardous animal.

6. The system according to claim 1 further comprising the acoustic sensor; wherein the acoustic sensor is arranged to transmit the detection signals only after determining that the detection signals represent the existence of the hazardous animal.

7. The system according to claim 1 wherein the hazardous animal is a rodent.

8. The system according to claim 1 wherein the hazardous animal is a mole.

9. A method comprising:

processing, by an analytics server, detection signals generated from an acoustic sensor that is configured to sense chirp sound signals generated by a hazardous animal to search for an existence of the hazardous animal; and generating information relating to the existence of the hazardous animal;

wherein the processing comprises:

calculating an attribute of a certain frequency component of a group of detection signals obtained by the acoustic sensor during a time window, wherein a certain frequency range of the detection signals is characteristic of the chirp sound signals generated by the hazardous animal; and wherein the calculating comprises:

calculating for each point of time out of multiple points in time of the time window, a sum of amplitudes of spectral components of the detection signals within the certain frequency range thereby providing multiple sums associated with the multiple points in time; and processing the multiple sums to search for a signature comprising a pattern of sums that is the characteristic of the chirp sound signals generated by the hazardous animal to indicate the existence of the hazardous animal.

10. The method according to claim 9 wherein the processing of the multiple sums comprises applying a fast Fourier transform on the multiple sums and to search in a frequency domain for the signature that is the characteristic of the chirp sound generated by the hazardous animal.

11. The method according to claim 9, further comprising processing additional detection signals generated from a carbon dioxide sensor that is configured to sense carbon dioxide omitted by the hazardous animal.

12. The method according to claim 11 further comprising processing the detection signals from the acoustic sensor and the carbon dioxide sensor before declaring the existence of the hazardous animal.

13. The method according to claim 9 comprising preventing from the acoustic sensor to process the detection signals to search for the existence of the hazardous animal.

14. The method according to claim 9 further comprising transmitting, by the acoustic sensor, the detection signals only after determining that the detection signals represent the existence of the hazardous animal.

15. The method according to claim 9 wherein the hazardous animal is a rodent.

16. The method according to claim 9 wherein the hazardous animal is a mole.

* * * * *